US009472851B2

(12) United States Patent
Chiang et al.

(10) Patent No.: US 9,472,851 B2
(45) Date of Patent: Oct. 18, 2016

(54) NONPLANAR ANTENNA EMBEDDED PACKAGE STRUCTURE AND METHOD OF MANUFACTURING THE SAME

(71) Applicant: NATIONAL CHUNG SHAN INSTITUTE OF SCIENCE AND TECHNOLOGY, Longtan Township (TW)

(72) Inventors: Chi-Haw Chiang, Longtan (TW); Chia-Hua Chang, Longtan (TW); Chih Wang, Longtan (TW); Chun-Yu Lee, Longtan (TW)

(73) Assignee: NATIONAL CHUNG SHAN INSTITUTE OF SCIENCE AND TECHNOLOGY (TW)

( * ) Notice: Subject to any disclaimer, the term of this patent is extended or adjusted under 35 U.S.C. 154(b) by 9 days.

(21) Appl. No.: 14/551,192

(22) Filed: Nov. 24, 2014

(65) Prior Publication Data

US 2015/0303574 A1 Oct. 22, 2015

(30) Foreign Application Priority Data

Apr. 16, 2014 (TW) ..... 103113785 A

(51) Int. Cl.
*H01Q 1/46* (2006.01)
*H01Q 9/04* (2006.01)

(52) U.S. Cl.
CPC ..... *H01Q 9/045* (2013.01); *H01Q 9/0471* (2013.01)

(58) Field of Classification Search
CPC ..... H01Q 1/82; H01Q 1/46; H01Q 11/08; H01Q 1/326
USPC ..... 343/905, 851, 842; 257/687
See application file for complete search history.

(56) References Cited

U.S. PATENT DOCUMENTS 6,031,505 A 2/2000 Qi et al.
6,818,985 B1 11/2004 Coccioli et al.
7,626,552 B2 * 12/2009 Sukegawa ..... H01L 23/48 257/724
8,063,846 B2 * 11/2011 Imaoka ..... H01Q 1/2283 343/851
9,007,273 B2 * 4/2015 Liao ..... H01L 23/481 343/841
2012/0212384 A1 8/2012 Kam

FOREIGN PATENT DOCUMENTS

TW 201043107 12/2010

* cited by examiner

*Primary Examiner* — Huedung Mancuso
(74) *Attorney, Agent, or Firm* — Schmeiser, Olsen & Watts, LLP

(57) ABSTRACT

A nonplanar antenna embedded package structure and a method of manufacturing the same are introduced. The structure includes a nonplanar antenna component. The nonplanar antenna component comprises an antenna substrate, metal wiring, through-hole, and metal bump. The substrate surface covers the metal wiring. The through-hole penetrates the substrate from the antenna substrate bottom side but does not penetrate the metal wiring, and does not affect its appearance. The metal bump is implanted in the through-hole from the antenna substrate bottom side to join the metal wiring. An electronic component having a copper cable is provided. An end of the copper cable protrudes from the electronic component and is inserted into the through-hole of the antenna component to join the metal bump, thereby forming the nonplanar antenna embedded package structure characterized by: preventing the antenna metal wiring from exposing, and reducing interference otherwise arising from antenna resonance frequency and noise.

13 Claims, 4 Drawing Sheets

NONPLANAR ANTENNA EMBEDDED PACKAGE STRUCTURE AND METHOD OF MANUFACTURING THE SAME

CROSS-REFERENCE TO RELATED APPLICATION

This non-provisional application claims priority under 35 U.S.C. §119(a) on Patent Application No(s). 103113785 filed in Taiwan, R.O.C. on Apr. 16, 2014, the entire contents of which are hereby incorporated by reference.

FIELD OF THE INVENTION

The present invention relates to nonplanar antenna embedded package structures and methods of manufacturing the same, and more particularly, to a manufacturing method which includes drilling an antenna to form therein a hole, filling the hole with a metal to join a copper cable in the nonplanar antenna, thereby forming an embedded package structure.

BACKGROUND OF THE INVENTION

According to the prior art, an antenna in a wireless communication device is a component for receiving or emitting electromagnetic wave, converting guided wave propagating along a transmission line into electromagnetic wave propagating in the space, or converting electromagnetic wave propagating in the space into guided wave propagating along a transmission line.

US2012/0212384 A1 discloses a chip package technique which requires a system of multilayer structure and uses drilling technology to connect layers. The first layer comprises components, such as an antenna or a radio frequency integrated circuit (RFIC). The exposed antenna is flattened out with a parallel-plate mode mechanism. The mechanism comprises a reflecting mirror which compensates for a force between a plane on which the antenna is grounded and a plane on which the first layer is drilled and grounded. The multilayer structure renders a manufacturing process complicated. U.S. Pat. No. 6,031,505 discloses an embedded antenna package technique which requires a planar structure comprising at least a zigzag antenna and a collection line, wherein the slightly bent structure serves to concentrate and compress the effective length of the antenna into a compact package, such that the structure separates a receiving line from a transmitting line, so as to function as a bidirectional antenna system. The slightly bent structure enhances electromagnetic coupling efficiency and therefore increases the bandwidth and benefits of the antenna.

U.S. Pat. No. 6,818,985 B1 discloses a semiconductor chip package technique to meet the need for antenna miniaturization and wireless device integration. U.S. Pat. No. 6,818,985 B1 provides a structure which comprises a laminate substrate with an upper surface layer for connecting with a semiconductor chip. The structure further comprises an antenna. The antenna is disposed on the upper surface layer of the laminate substrate. The antenna connects with soldering points of the laminate substrate and then connects with soldering points of the semiconductor chip. In doing so, signals can be transmitted between capacitors or inductors controlled by the antenna and the semiconductor chip. However, U.S. Pat. No. 6,818,985 B1 has a drawback, that is, the soldering points are exposed and therefore cause antenna interference, leading to deterioration of performance of electronic components. Taiwan Patent 201043107 A1 provides a package structure of surface-mount components and discloses that the surface-mount structures (such as electronic components, active/passive components, integrated circuit chips, and chip antennas) are integrated by vacuum hot pressing and technology. The surface-mount structure comprises: a dielectric substrate; a first surface metal layer disposed on an upper surface of the dielectric substrate; a second surface metal layer disposed on a lower surface of the dielectric substrate; a plurality of plated-through holes disposed in the dielectric substrate to electrically connect the first surface metal layer and the second surface metal layer; and an electronic component adhered to the surface of the first surface metal layer. Therefore, Taiwan Patent 201043107 A1 provides a carrying function and a structure protection function and ensures normal transfer of signals and energy, wherein packaging is performed by a planar component surface-mount technique.

Related conventional antenna package techniques, which apply to patents pertaining to 3D integrated circuits and wireless communication devices, aim to improve package structures and therefore address issues, such as connections between antenna/silicon vias and integration of miniaturized wireless devices. Some patents disclose embedded antenna package devices, such as bent or zigzag structures, for enhancing RFIC efficiency. However, existing patents do not address related issues posed by conventional antenna package methods, including: metal wiring exposure, interference induced by the soldering points of a wiring package, and deterioration of component performance. In view of this, the present invention provides a novel nonplanar three-dimensional antenna embedded package structure and a method of manufacturing the same for improving the drawbacks of conventional three-dimensional antenna package methods. Referring to FIG. 1, a conventional antenna package structure is shown. As shown in FIG. 1, a nonplanar antenna component 100 comprises an antenna substrate 110. A surface of the antenna substrate 110 covers with a metal wiring 120. An electronic component 130 to be packaged has therein at least a copper cable 140, such that the interconnect of the nonplanar antenna component 100 is effectuated by the copper cable. To effectuate mutual joining and fixing, the copper cable has to protrude (i.e., be exposed) from a plane of a three-dimensional antenna having a metal wiring, and soldering is effectuated with solder balls 150 formed solely by a conventional manual soldering process. As a result, the copper cable 140 protruding from the metal wiring 120 to cause interference arising from antenna resonance frequency and noise.

The overview above and the description below further explain the techniques and measures taken by the present invention to achieve its intended objectives as well as the effects attained. The other objectives and advantages of the present invention are described below.

SUMMARY OF THE INVENTION

In view of the aforesaid drawbacks of the prior art, it is an objective of the present invention to provide a nonplanar antenna embedded package structure. The structure comprises a nonplanar antenna component and an electronic component. The nonplanar antenna component comprises an antenna substrate, a metal wiring, a through-hole, and a metal bump. A surface of the antenna substrate covers with the metal wiring. The through-hole penetrates the antenna substrate from the bottom side of the antenna substrate but does not penetrate the metal wiring, such that the metal wiring becomes a closed side of the through-hole. The through-hole does not affect the appearance of the metal wiring. The metal bump is implanted in the through-hole from the bottom side of the antenna substrate to join the metal wiring. The electronic component has therein a copper cable. An end of the copper cable protrudes from the electronic component. Another end of the copper cable is received in the electronic component. An end of the copper cable is inserted into the through-hole of the nonplanar antenna component to join the metal bump. Therefore, the nonplanar antenna embedded package structure is formed.

Another objective of the present invention is to provide a nonplanar antenna embedded package manufacturing method, providing a nonplanar antenna component, wherein the nonplanar antenna component comprises an antenna substrate and a metal wiring covering on a surface of the antenna substrate; drilling a bottom side of the nonplanar antenna component to form a through-hole, wherein the through-hole penetrates the antenna substrate from a bottom side of the antenna substrate but does not penetrate the metal wiring, such that the metal wiring becomes a closed side of the through-hole, wherein the through-hole does not affect the appearance of the metal wiring; implanting a metal bump in the through-hole to form a join end; providing an electronic component having a copper cable, wherein an end of the copper cable protrudes from the electronic component, and another end of the copper cable is received in the electronic component; and inserting an end of the copper cable of the electronic component into the through-hole to connect with the join end, followed by performing alignment and reflow such that the copper cable and the metal bump are joined and fixed to each other, thereby forming a nonplanar antenna embedded package component.

Regarding the package component of the present invention, the drilling technique (via technique) is achieved by a mechanical means, laser, sandblasting, or wet etching to form the through-hole. The through-hole corresponds in dimensions and quantity to the copper cable. The through-hole corresponds in position to an end point of the metal wiring of the nonplanar antenna component. The metal bump is made of tin or tin-based alloy.

The present invention provides a nonplanar antenna embedded package structure and a method of manufacturing the same to prevent a metal wiring from exposing and reduce the interference otherwise induced by the soldering points of the wiring package and therefore deterioration of the performance of the electronic component, so as to reduce the interference otherwise arising from antenna resonance frequency and noise and enhance antenna electronic performance. The manufacturing method of the present invention improves conventional antenna package methods.

DETAILED DESCRIPTION OF THE PREFERRED EMBODIMENTS

Figure 1:
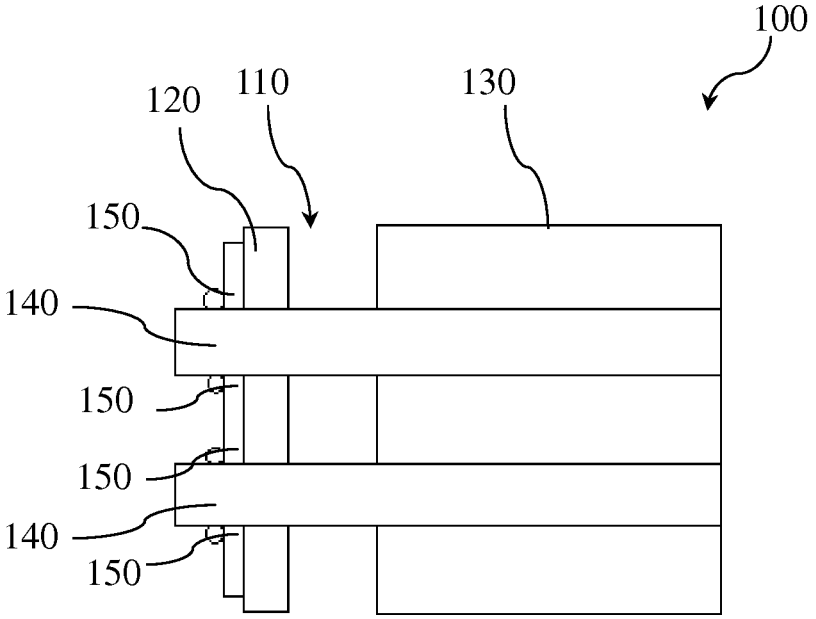
FIG.1 (PRIOR ART)
FIG. 1 (PRIOR ART) is a schematic view of a conventional antenna package structure.
Figure 2:
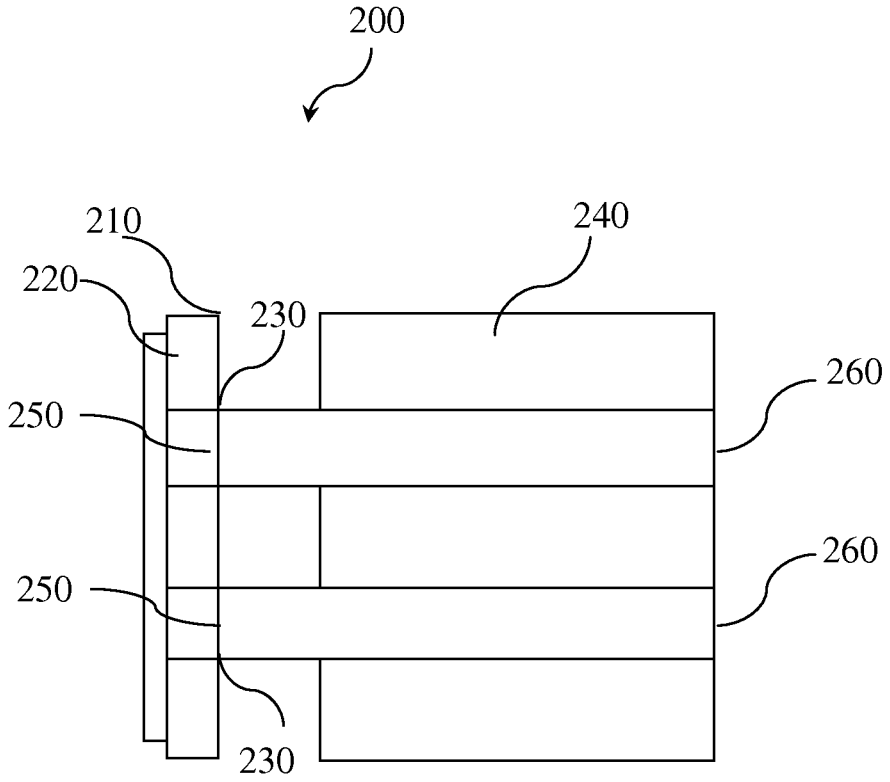
FIG. 2 is a schematic view of a nonplanar antenna embedded package structure according to an embodiment of the present invention.

The implementation of the present invention is hereunder illustrated with specific embodiments. After studying the disclosures contained herein, persons skilled in the art gain insight into the other advantages and effects of the present invention readily. Referring to FIG. 2, there is shown a schematic view of a nonplanar antenna embedded package structure according to an embodiment of the present invention. As shown in the diagram, the nonplanar antenna embedded package structure comprises a nonplanar antenna component 200 and an electronic component 240. The nonplanar antenna component 200 comprises an antenna substrate 210, a metal wiring 220, a through-hole 230, and a tin bump 250. A surface of the antenna substrate 210 covers with the metal wiring 220. The through-hole 230 penetrates the antenna substrate 210 from the bottom side of the antenna substrate 210 but does not penetrate the metal wiring 220. The tin bump 250 is implanted in the through-hole 230 from the bottom side of the antenna substrate 210 to join the metal wiring 220. The electronic component 240 has therein a copper cable 260. An end of the copper cable 260 protrudes from the electronic component 240. Another end of the copper cable 260 is received in the electronic component 240. An end of the copper cable 260 is inserted into the through-hole 230 of the nonplanar antenna component 200 to join the tin bump 250. Therefore, the nonplanar antenna embedded package structure is formed.

Figure 3:
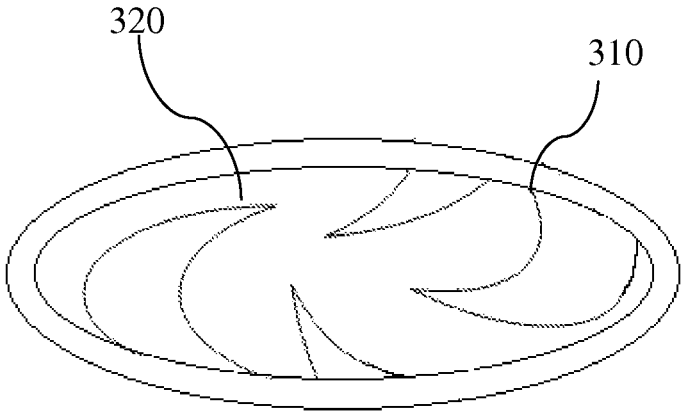
FIG. 3 is a schematic view of an antenna surface metal wiring according to the embodiment of the present invention.
Figure 4:
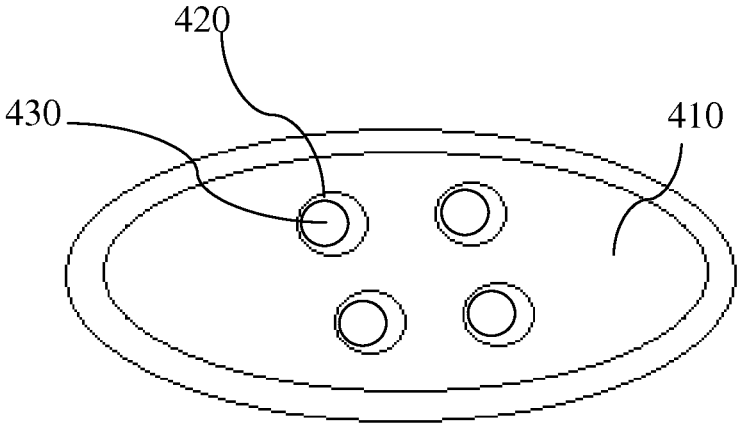
FIG. 4 is a schematic view of an antenna bottom side through-hole according to the embodiment of the present invention.

Referring to the present invention FIG. 3 and FIG. 4, there is shown in FIG. 3 a schematic view of an antenna surface metal wiring, and there is shown in FIG. 4 a schematic view of an antenna bottom side through-hole. As shown in the diagrams, a metal wiring 320 is disposed on an antenna surface 310, whereas a through-hole 420 is disposed on an antenna bottom side 410 and has therein a tin bump 430. The through-hole 420 corresponds in position to an end point of the metal wiring 320 of the nonplanar antenna component. The through-hole 420 neither penetrates the metal wiring 320 nor affects the appearance of the metal wiring 320 on the antenna surface 310.

Figure 5:
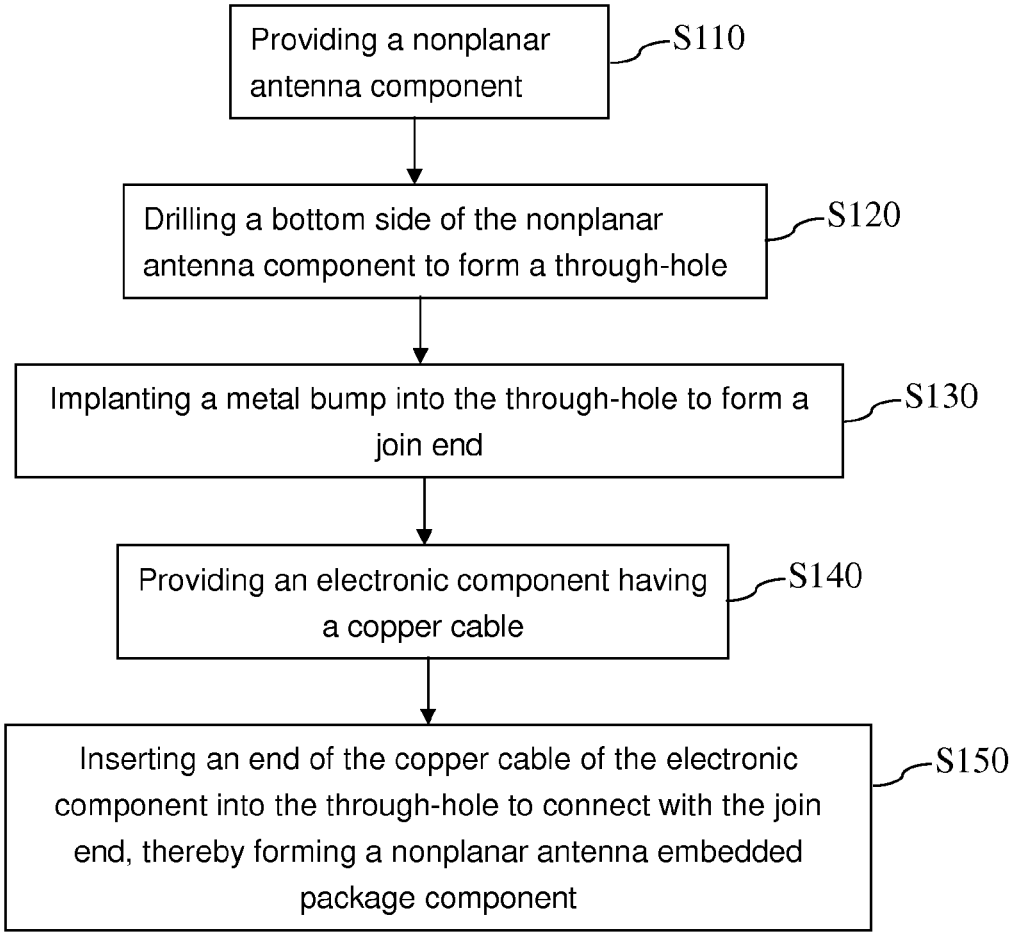
FIG. 5 is a flowchart of a nonplanar antenna embedded package manufacturing method according to another embodiment of the present invention.

Referring to FIG. 5, there is shown a flowchart of a nonplanar antenna embedded package manufacturing method according to another embodiment of the present invention. As shown in the diagram, the method comprises the steps of: providing a nonplanar antenna component S110, wherein an antenna substrate of the nonplanar antenna component is made of an insulating material, and a surface of the antenna substrate covers with a metal wiring; drilling the bottom side of the nonplanar antenna component to form a through-hole S120, wherein the through-hole penetrates the antenna substrate from the bottom side of the antenna substrate but does not penetrate the metal wiring, such that the metal wiring becomes a closed side of the through-hole, wherein the through-hole does not affect the appearance of the metal wiring; providing a metal bump (made of tin, for example) corresponding in dimensions to the through-hole and adapted to be implanted in the through-hole to form a join end S130; providing an electronic component having therein a copper cable S140, wherein the copper cable corresponds in quantity and dimensions to the through-hole; inserting an end of the copper cable of the electronic component into the through-hole to connect with the join end, thereby forming a nonplanar antenna embedded package component S150, wherein a package alignment apparatus performs alignment and reflow on the copper cable and the metal bump (made of tin, for example) in the antenna through-hole, wherein the reflow requires heating the metal bump (made of tin, for example) partially by baking or hot air to melt the metal bump, and then the copper cable and the metal bump (made of tin, for example) are joined and fixed to each other. According to the present invention, the through-hole of the copper cable and the antenna are formed by antenna back drilling technology (via technology), and solder functions as soldering points of the antenna and the copper cable. Therefore, the soldering points of the antenna are embedded in the three-dimensional antenna of the present invention rather than exposed on the same plane of a metal wiring of an antenna packaged in a conventional way. The package structure of the present invention prevents the interference otherwise arising from antenna resonance frequency and noise and enhances antenna-related electronic performance.

The aforesaid embodiments are illustrative of the features and effects of the present invention rather than restrictive of the scope of the substantive technical contents of the present invention. Persons skilled in the art may modify and change the aforesaid embodiments without departing from the spirit and scope of the present invention. Therefore, the protection for the rights of the present invention should be defined by the appended claims.

What is claimed is:

1. A method of manufacturing a nonplanar embedded package, the method comprising the steps of:

(1) providing a nonplanar antenna component comprising an antenna substrate and a metal wiring covering on a surface of the antenna substrate;

(2) drilling a bottom side of the nonplanar antenna component to form a through-hole, wherein the through-hole penetrates the antenna substrate from a bottom side of the antenna substrate but does not penetrate the metal wiring;

(3) implanting a metal bump into the through-hole to form a join end;

(4) providing an electronic component having a copper cable, wherein an end of the copper cable protrudes from the electronic component, and another end of the copper cable is received in the electronic component; and (5) inserting an end of the copper cable of the electronic component into the through-hole to connect with the join end, followed by performing alignment and reflow such that the copper cable and the metal bump are joined and fixed to each other, thereby forming a nonplanar antenna embedded package component;

wherein the through-hole corresponds in position to an end point of the metal wiring of the nonplanar antenna component.

2. The method of claim 1, wherein the drilling process is performed by one of a mechanical means, laser, sandblasting, and wet etching.

3. The method of claim 1, wherein the through-hole corresponds in dimensions to the copper cable.

4. The method of claim 1, wherein the copper cable is in the number of one or at least one.

5. The method of claim 1, wherein the through-hole corresponds in quantity to the copper cable.

6. The method of claim 1, wherein the metal bump is made of one of tin and tin-based alloy.

7. The method of claim 1, wherein the reflow requires heating the metal bump partially by one of baking and hot air, such that the copper cable and the metal bump are joined and fixed to each other.

8. A nonplanar embedded package structure, comprising:

a nonplanar antenna component comprising an antenna substrate, a metal wiring, a through-hole, and a metal bump, wherein a surface of the antenna substrate covers with the metal wiring, wherein the through-hole penetrates the antenna substrate from a bottom side of the antenna substrate but does not penetrate the metal wiring, wherein the metal bump is implanted in the through-hole from a bottom side of the antenna substrate such that the metal bump and the metal wiring are joined and fixed to each other; and an electronic component having therein a copper cable, wherein an end of the copper cable protrudes from the electronic component, and another end of the copper cable is received in the electronic component, wherein an end of the copper cable is inserted into the through-hole of the nonplanar antenna component to join the metal bump, thereby forming the nonplanar antenna embedded package structure;

wherein the through-hole corresponds in position to an end point of the metal wiring of the nonplanar antenna component.

9. The nonplanar embedded package structure of claim 8, wherein the through-hole corresponds in dimensions to the copper cable.

10. The nonplanar embedded package structure of claim 8, wherein the copper cable is in the number of one or at least one.

11. The nonplanar embedded package structure of claim 8, wherein the through-hole corresponds in quantity to the copper cable.

12. The nonplanar embedded package structure of claim 8, wherein the metal bump is made of one of tin and tin-based alloy.

13. A nonplanar embedded package structure, comprising:

a nonplanar antenna component comprising an antenna substrate, a metal wiring, a through-hole, and a metal bump, wherein a surface of the antenna substrate covers with the metal wiring, wherein the through-hole penetrates the antenna substrate from a bottom side of the antenna substrate but does not penetrate the metal wiring, wherein the metal bump is implanted in the through-hole from a bottom side of the antenna substrate such that the metal bump and the metal wiring are joined and fixed to each other; and an electronic component having therein a copper cable, wherein an end of the copper cable protrudes from the electronic component, and another end of the copper cable is received in the electronic component, wherein an end of the copper cable is inserted into the through-hole of the nonplanar antenna component to join the metal bump, thereby forming the nonplanar antenna embedded package structure;

wherein the metal wiring becomes a closed side of the through-hole, and the through-hole does not affect appearance of the metal wiring.

* * * * *